United States Patent [19]

Rodas

[11] Patent Number: 4,995,670

[45] Date of Patent: Feb. 26, 1991

[54] HAIRDRESSER FOOT REST

[76] Inventor: Wilson A. Rodas, R.D. 2 Quannacut Rd., Pine Bush, N.Y. 12566

[21] Appl. No.: 474,291

[22] Filed: Feb. 2, 1990

Related U.S. Application Data

[63] Continuation of Ser. No. 228,892, Aug. 5, 1988, abandoned.

[51] Int. Cl.[5] ..... A47C 7/50

[52] U.S. Cl. ..... 297/423; 297/437

[58] Field of Search ..... 297/240, 241, 242, 423, 297/437; 312/140.4; 248/251

[56] References Cited

U.S. PATENT DOCUMENTS

| | | | |
|---|---|---|---|
| 285,403 | 9/1883 | Gaetje | 312/140.4 |
| 336,220 | 2/1886 | Farrar | 297/242 |
| 1,006,626 | 10/1911 | Boehm | 248/251 |
| 1,083,357 | 1/1914 | Eikenberg | 312/140.4 |
| 1,415,252 | 5/1922 | McManis et al. | 297/425 |
| 1,933,096 | 10/1933 | Child | 297/423 |
| 2,678,086 | 5/1954 | Mohr | 297/240 |
| 2,848,037 | 8/1958 | MacKnight | 297/240 |
| 2,919,746 | 1/1960 | Fidel | 297/423 |
| 3,820,844 | 6/1974 | Fortnam | 297/437 |
| 3,843,197 | 10/1974 | Wright | 297/437 |
| 4,348,051 | 9/1982 | Boucher | 297/437 |
| 4,623,195 | 11/1986 | Avella | 297/437 |

*Primary Examiner*—Jose V. Chen

*Attorney, Agent, or Firm*—Schweitzer, Cornman & Gross

[57] ABSTRACT

A foot rest unit is removably secured to the base of a styling chair to support a foot of a hairdresser. The unit is vertically adjustable and consists of a circumferential ring of one or more segments. Each segment is supported by upwardly and outwardly-extending legs having tongues removably anchored under the chair base. A sleeve at the top of the leg engages the ring segment and is adjustable to retain the segment in place.

5 Claims, 3 Drawing Sheets

HAIRDRESSER FOOT REST

This application is a continuation of application Ser. No. 228,892, filed Aug. 5, 1988 now abandoned.

This invention relates to a hairdresser foot rest and more particularly to a foot rest unit secured to a styling chair.

BACKGROUND OF THE INVENTION

Many people perform services on others who are seated in chairs. An example is a hairdresser performing services on customers in a styling chair.

Hair stylists or beauticians, working under these conditions on a continuous basis, often develop back and feet problems. This is often created because of the continuous standing necessary in order to properly perform the services required. The vertical support of the weight is constantly shifting and tends to cause strains particularly in the back muscles.

There have been previous attempts to alleviate problems of support, but they are generally directed towards people sitting in chairs. For example, U.S. Pat. No. 1,933,096 discloses a circular ring for secured to the curved base legs of a chair. Adjustable supports are shown by U.S. Pat. Nos. 2,308,358 and 2,659,413. U.S. Pat. No. 3,820,844 does show a form of vertical support member with respect to a foot rest.

OBJECTS AND ADVANTAGES OF THE PRESENT INVENTION

Accordingly, among the principal objects of the present invention is to provide a foot support unit for a person standing and working around a sitting person.

Another object of the present invention is to provide a foot rest unit which will allow the person performing the services to work comfortably for longer periods of time.

Still yet another object of the present invention is to provide a unit of the character described which will lessen back problems caused by standing work.

Still yet a further object of the present invention is to provide a unit of the character described which is adjustable so as to conform to different size chairs.

Another object of the present invention is to provide a foot rest unit which may be removable so that it can be transferred to different chairs.

Another object of the present invention is to provide a device of the character described which will be simple and economical to manufacture and yet be durable to a high degree in use.

The present invention contemplates a unit which may be removably secured to the base of any styling chair. Such a chair consists of a base portion, a pedestal with a generally rigid male member and a vertically adjustable female member supporting a chair.

Surrounding the chair is a ring structure which is capable of of sliding vertically up and down on the stationary portion of the pedestal. It has an inner diameter just slightly larger then that of the stationary pedestal portion. Secured to this ring are a series of outwardly radial spokes attached to a larger outer ring. The ring can be a full 360° or may be interrupted for a portion to accommodate the standard chair lock which is used to retain the male portion of the pedestal and the chair in a desired vertical height position. The outer ring also may be supported by vertical legs rather resting on the floor. The legs also may be vertically adjustable. The ring may be covered with a soft material in order to provide a pleasant feel for the foot.

Some styling chairs have skirts surrounding the base. In that case a tongue may be secured to the ring or even a spoke and may consist of a downwardly extending vertical leg in a horizontal leg which passes out beyond and underneath the skirt. Furthermore, it is possible to provide tongues which slip under the base and support a ring doing away with the radial spokes and the inner ring. This tongue may have an upperwardly extending leg portion ending at a sleeve with an oppositedly disposed angular leg to provide proper support. The sleeve may receive segments of a ring. The segments are designed to accommodate the foot rest and the lock, as is necessary. The segments are secured in the sleeves which may be adjustable tight.

DETAILED DESCRIPTION OF THE INVENTION

DETAILED DESCRIPTION OF THE DRAWINGS

Figure 1:
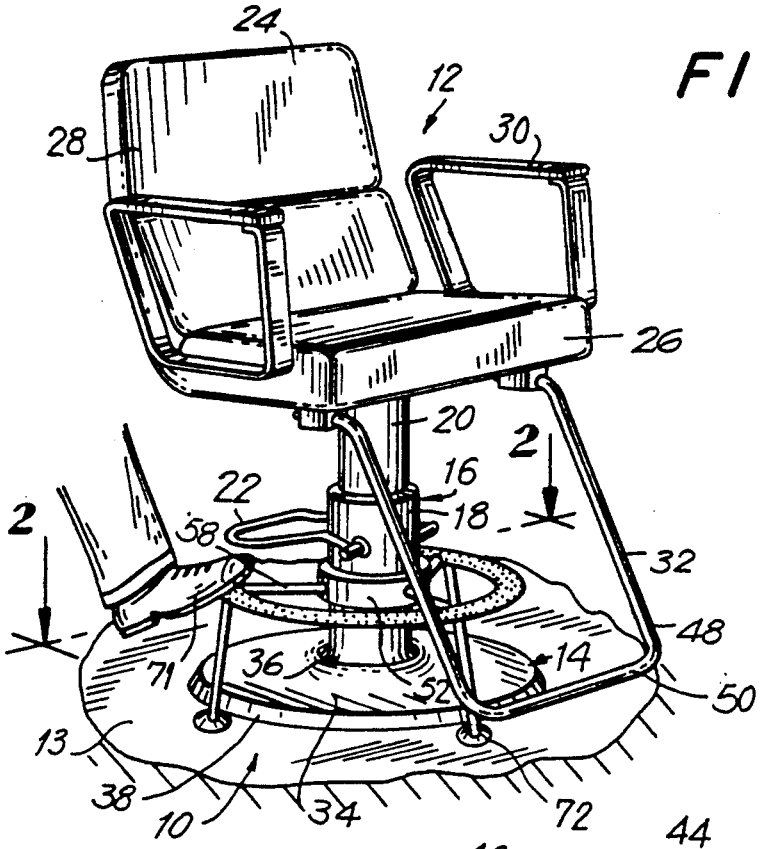
FIG. 1 is a front perspective view of my invention in position around the styling chair and showing the foot of a user thereon.

Turning to the drawings and particular to FIG. 1, there is shown a foot rest unit 10 adjustably and removably secured to a styling chair 12.

The chair is mounted on a floor 13 and includes a base 14, a pedestal 16 consisting of female member 18 and adjustable male member 20 a chair lock 22 and a chair 24. The chair includes the usual seat 26, back rest 28 and arm rests 30. Extending downwardly and forwardly from the seat 26 is the customer foot rest 32.

Figure 3:
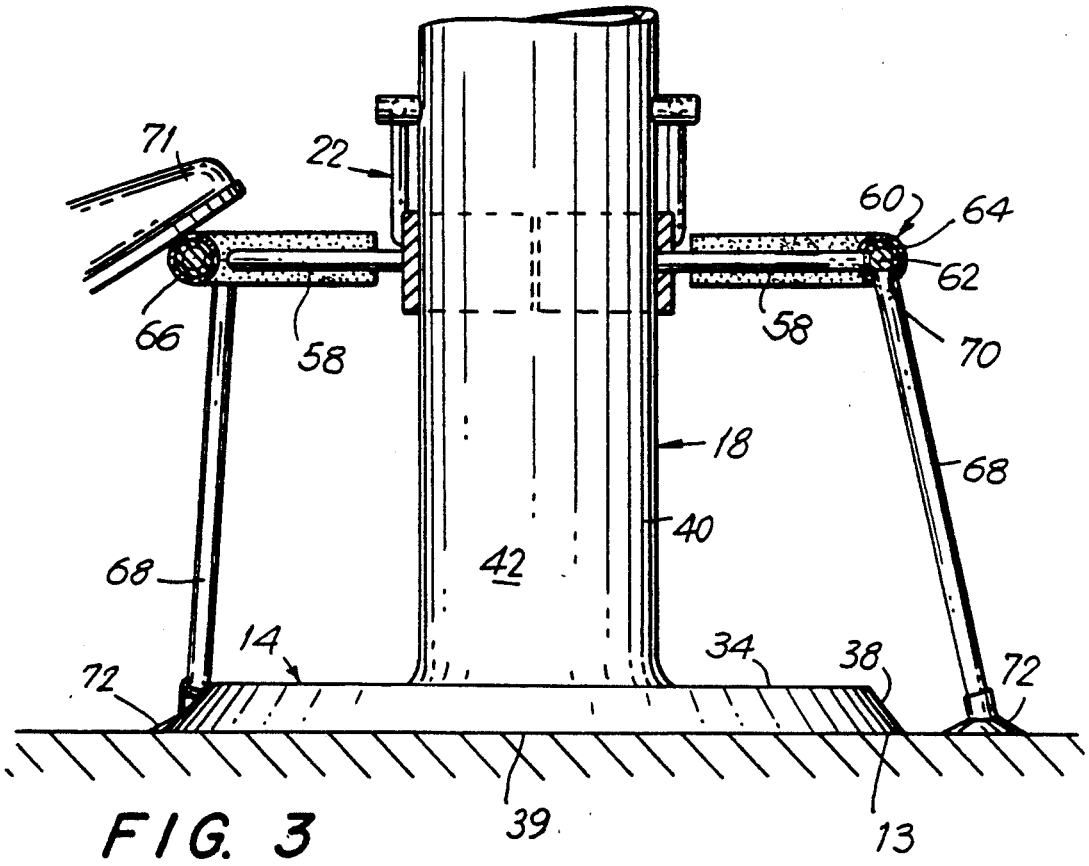
FIG. 3 is an enlarged cross-sectional elevational view taken lines 3—3 of FIG. 2.

As seen in FIG. 3 the base 14 is defined by an upper wall 34 which is circular and contains a central opening 36 (FIG. 1). Depending downwardly from the outer circumference of the circular wall 34 is an angle perimeter wall 38 which meets the bottom wall of 39 of the base, abutting the floor 13.

Female pedestal member 18 includes a cylindrical wall 40 having an outer surface 42. The chair lock 22 is formed (FIGS. 1 and 2) from a C -Shaped rod 44 with a foot engaging portion 46. Similarly, the customer foot rest portion 32 is also defined of a C -Shaped rod 48 with a foot engaging portion 50.

Figure 2:
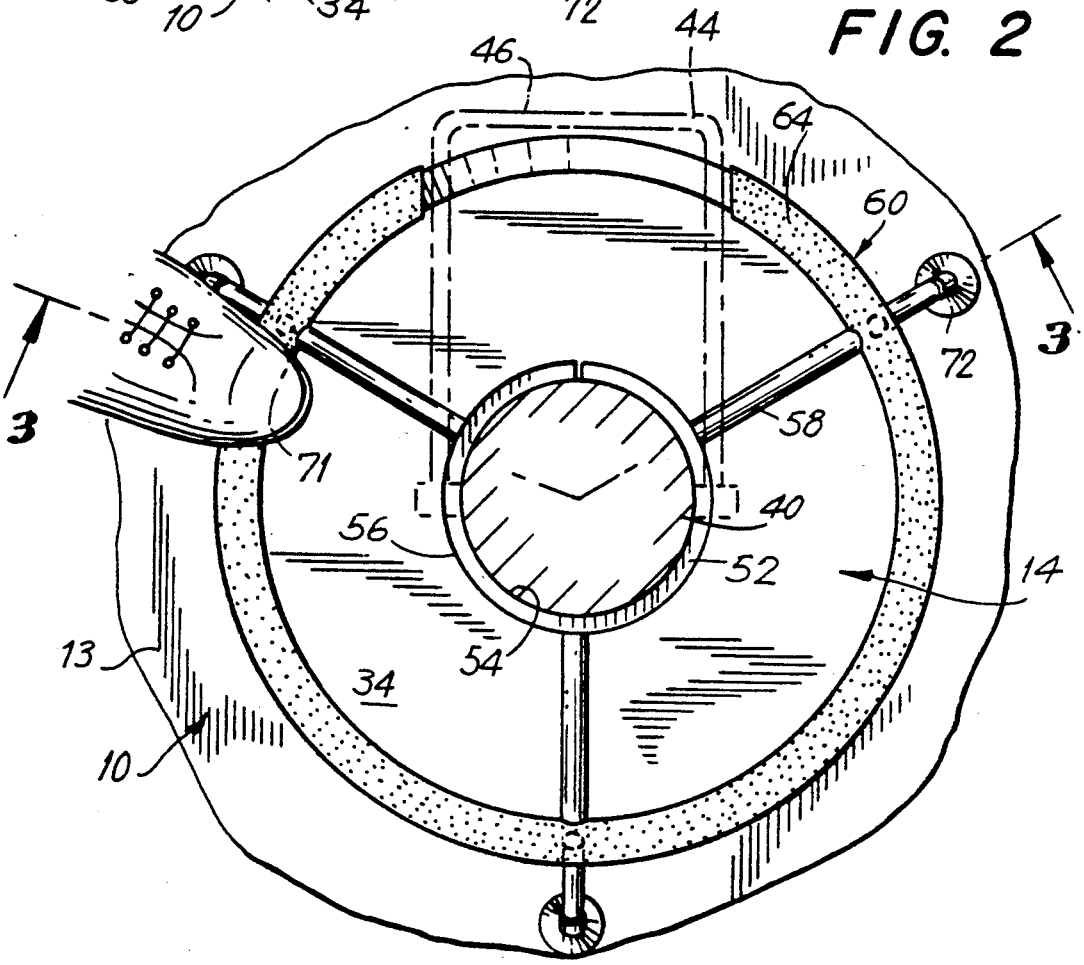
FIG. 2 is an enlarged cross-sectional plan view taken along the line 2—2 of FIG. 1.

Turning to the invention, the foot rest as shown in FIGS. 1–3 includes an inner cylindrical ring 52 defined by an inner surface 54 and an outer surface 56. Depending outwardly from the ring 52 are a plurality of radial directed spokes 58. The spokes may be secured to the inner ring by any desired means such as welding or by the presence of threaded holes in the inner ring receiving threaded ends of the spokes. The other ends of the spokes are secured to the outer cylindrical ring 60. This ring may be a full 360° in circumference or may be less then that in order, for example, to accommodate the movement of the chair lock 22. The outer ring tends to be calibrated when fabricated to fit over an average 23 inch base. This will accommodate the size of the chair base perimeters which run from 21 inches to 25 inches. At the largest size it may have an opening in the front with the ring cut into two segments. This presents no problems since the stylist does not use the front area which is otherwise occupied by the customer foot rest 32. As best seen in FIG. 3 the ring is composed of a rigid central core to which the outer ends of the spokes may be welded or which may contain threaded holes receiving tap ends of the outer spokes. The rigid core 62 is surrounded by a sponge like material 64 such as resilient polymeric materials, one example being polyurethane foams. A skin 66 surrounds the whole unit. The skin may be made of rubber or polyethylene. The whole unit is designed to provide a foot rest that will "give" and feel comfortable. In order to insure that the foot rest is at a proper height for the user, and to provide proper vertical support strength, a vertical arm 68 may be secured to the core 62 by a weld 70. The arm can be one length or it can be a telescopic type arm to allow vertical adjustments. The base of the leg may carry a suction cup 72 to provide better securement.

When the unit is placed around the chair the legs 68 may be, if adjustable, adjusted to a desired height and the suction cups placed in position on the floor 13. The user may then, as desired, rest his or her foot 71. As the stylist is working on a person seated in the chair, the ability to rest a foot on the foot rest unit reduces fatique on the feet and also significantly reduces the strain on the stylist's back.

Figure 4:
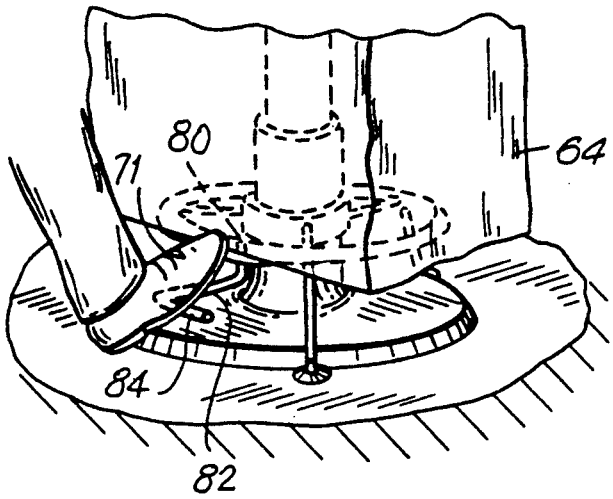
FIG. 4 is a rear perspective view showing a modified embodiment of my invention.

Some styling chairs have skirts surrounding the base portion in order to prevent what designers feel is a more esthetically pleasing appearance. As shown in FIG. 4 the skirt 64 surrounds the foot rest unit 10. To take advantage of the invention a tongue has a vertical leg 80 that is secured to the rigid core 62 of the ring by any desirable securement means as previously mentioned. The leg is bent and has a horizontal leg 82 extending outwardly from underneath the skirt and terminating in a foot support tongue 84. The foot of the user can be seen resting on it. Obviously, this tongue is narrower and shorter then the regular ring but it provides in a more limited fashion, the benefits of the invention. Certainly, it is vastly superior to what the stylist is faced with at the present.

Figure 5:
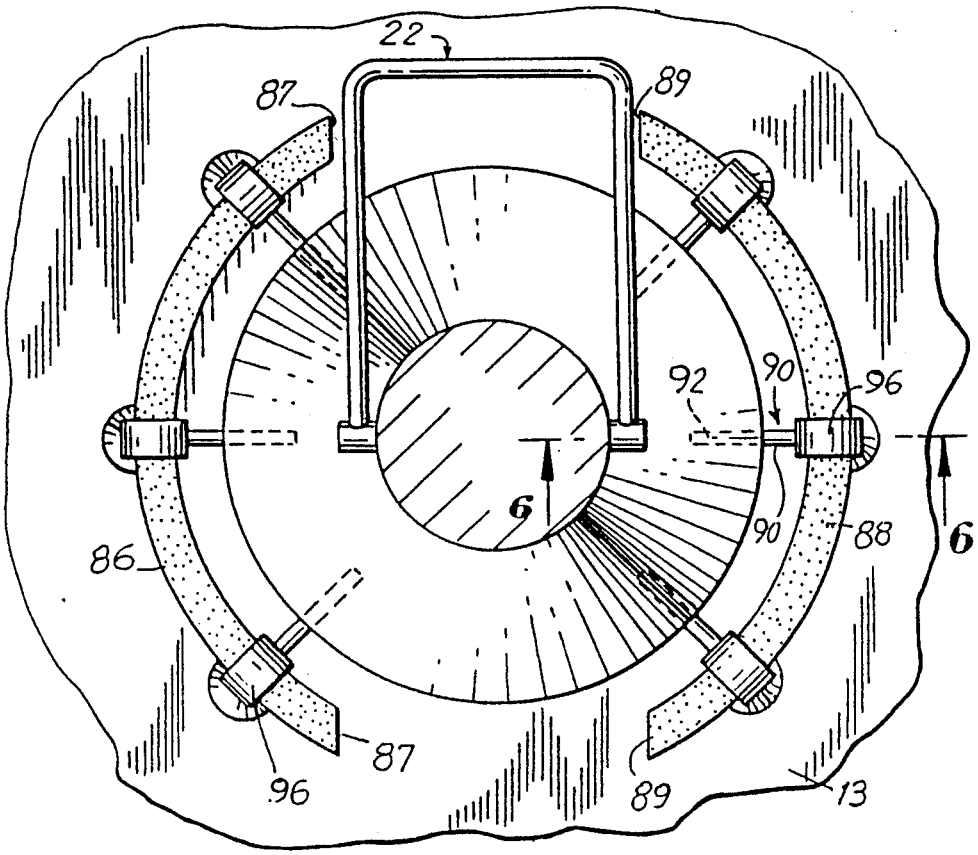
FIG. 5 is an enlarged plan sectional view similar to FIG. 2, showing a modified embodiment of my invention.
Figure 6:
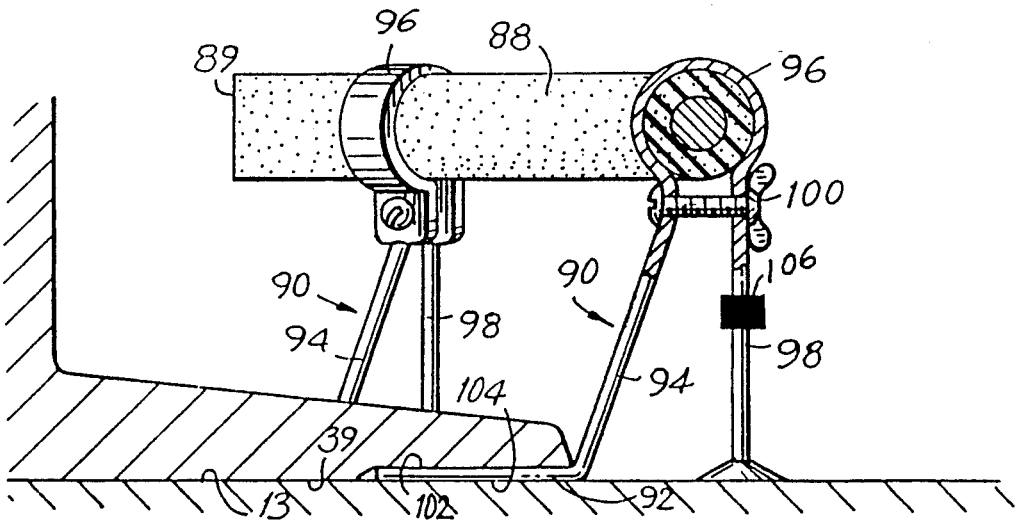
FIG. 6 is an enlarged side elevational view taken along the line 6—6 of FIG. 5.

FIGS. 5 and 6 show another embodiment of the present invention. The ring is divided into two circular segments The left segment 86 is defined by ends 87 and the right circular segment 88 is defined by ends 89. The segments are the same construction as the outer cylindrical ring 60. A tongue 90 has a horizontal leg 92 which slides underneath the base 14 being sandwiched between the lower wall 39 and the floor 13. It then has an upwardly extending angular leg 94 which supports a sleeve 96. Similarly, an oppositely opposed leg 98 extends down and touches the floor 13. The two angular legs provide proper and rigid support for the sleeve 96. The segments are received within the sleeves and they are at least three tongues for each segment. The sleeves may be tightened around the segments such as by wing nuts 100 or other similar easily adjustable means, such as allan nuts. When the tongue is slid underneath the base, the upper surface 102 of the horizontal tongue contacts the lower wall 39 of the base and the lower surface 104 contacts the upper surface of the floor 13. This engagement with the weight of the chair provides sufficient basis to anchor the tongue. The legs 94, 98 provide sufficient support so that when the user's foot is placed upon the segments 86, 88, the forces are easily transmitted down along the legs and into the floor. Normally, the height is not adjustable, although the legs 94 and 98 could be made telescopic as depicted at 106.

The leg 98 is normally perpendicular to the floor so it does not impede the movement of the user's feet while moving around the chair. If the legs were angled outwardly the user would have to consciously step around the legs so as not to trip over one of them.

Thus, there is provided a similar yet highly effective means for conserving the energy of a stylist and for eliminating fatigue both in the legs and particularly in the back. It is obvious that this system can be used for anyone working or a person in a seated position. Examples might be someone doing a facial or giving an upper body massage.

As can be seen, the present invention provides a significant advance over the state of the technology. As numerous additions, modifications and constructions can be performed within the scope of the invention, such scope is to be measured by the claims herein.

What is claimed:

1. A portable footrest for use with a styling chain having a circular base positioned on the floor, an upstanding pedestal projecting from the base and a chair mounted to the upper end of the pedestal, said footrest comprising a circular foot support assembly means substantially encircling the pedestal and adapted to support the foot of the user but not engaging said pedestal, said foot support assembly means comprising at least one independent arcuate segment having vertical support means to provide a non-rotational vertical support and positioning of said foot support assembly means, said foot support assembly means being vertically spaced above said floor to permit the stylist-user to rest a foot thereon without movement to said support assembly; said vertical support means mounted to said foot support assembly and extending downwardly therefrom, said support means including means to removably mount said support means to said chair base, said means to removably mount including a tongue adapted to be inserted between said chair base and the floor for frictional positioning therebetween and having a vertical portion having an adjustable sleeve adapted to receive the arcuate segment, said sleeve having means to removably secure the arcuate segment thereto.

2. The invention according to claim 1, wherein said arcuate segments are at least two in number.

3. The invention according to claim 2, wherein each arcuate segment is supported by at least three of said support means.

4. The invention according to claim 3, said tongue including a horizontal leg portion adapted to be removably secured between the chair base and floor and extending radially outwardly, an angular leg portion connected to said horizontal leg portion and extending upwardly and outwardly from said horizontal leg and carrying said sleeve, and a second opposed leg mounted to said sleeve and extending downwardly towards the floor.

5. The invention according to claim 4, said sleeve having a wing-nut to allow the tightening and loosening of said sleeve for anchoring and releasing said segment as desired.

* * * * *